United States Patent [19]

Ganzer

[11] Patent Number: 5,033,741

[45] Date of Patent: Jul. 23, 1991

[54] ISOMETRIC PUSH-UP MACHINE

[76] Inventor: Gregory F. Ganzer, 1423 Chicago Ave., Bay Shore, N.Y. 11706

[21] Appl. No.: 385,199

[22] Filed: Jul. 26, 1989

[51] Int. Cl.[5] ..... A63B 21/02

[52] U.S. Cl. ..... 272/135; 272/138

[58] Field of Search ..... 272/130, 134, 135, DIG. 4, 272/143, 144; 128/254

[56] References Cited

U.S. PATENT DOCUMENTS 4,226,415 10/1980 Wright ..... 272/134

*Primary Examiner*—Richard J. Apley
*Assistant Examiner*—Jerome Donnelly
*Attorney, Agent, or Firm*—Michael I. Kroll

[57] ABSTRACT

A wall mounted isometric push-up machine for a user is disclosed. Included is a first member having a first end and a second end, a second member having a second end and a first end that is pivotally connected to the first end of the first member, an applicator being fixedly connected to the second end of the second member, wherein a spring is used for regulating the tension the applicator applies to the back of the user so that the user can choose his own comfortable amount.

25 Claims, 2 Drawing Sheets

Fig. 4
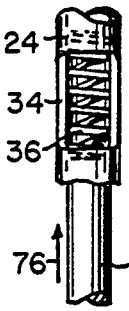
Fig. 4A
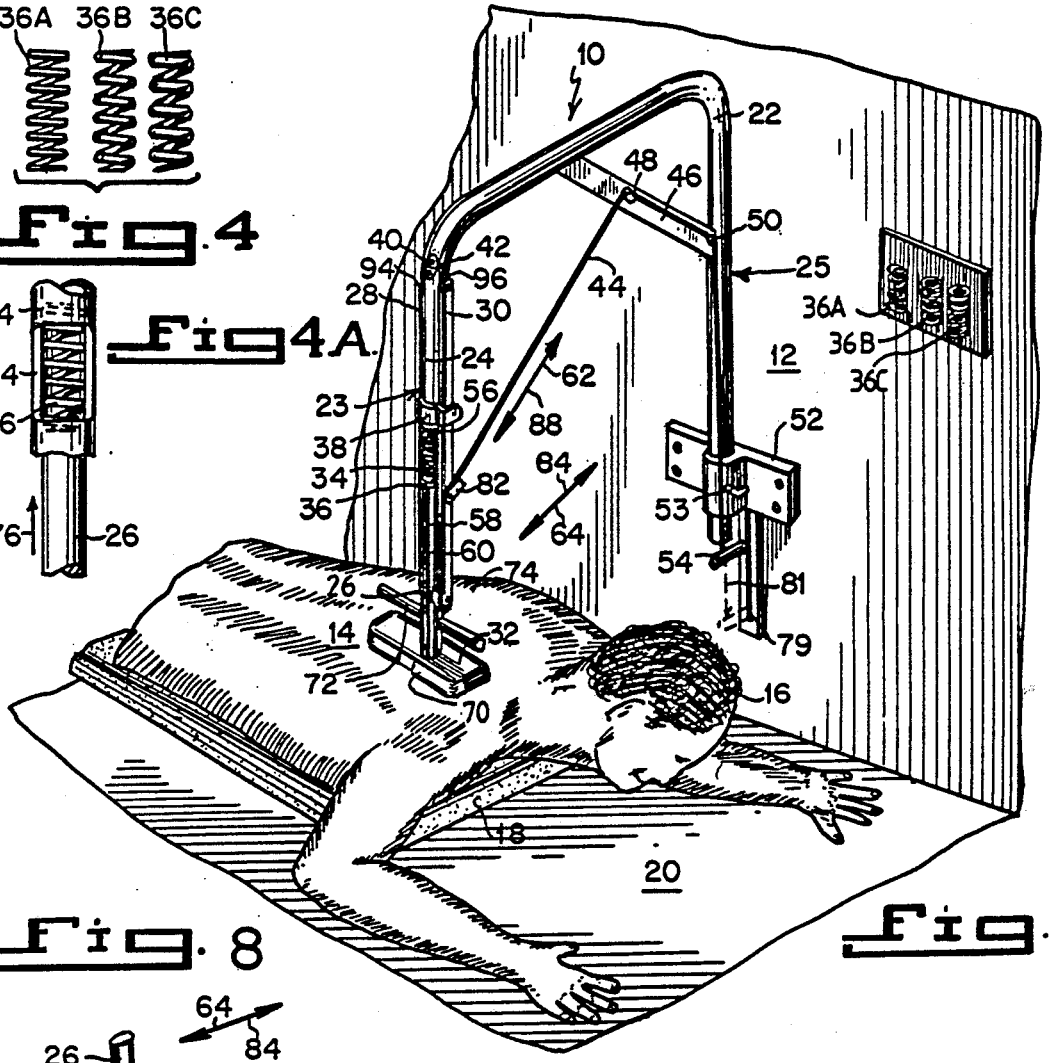
Fig. 8
Fig. 1
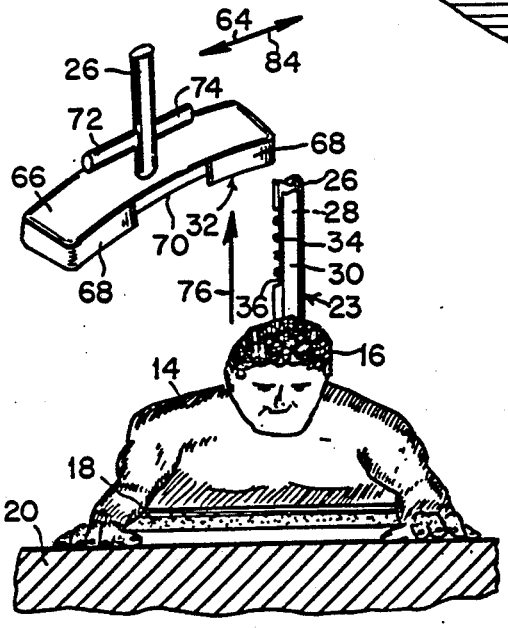
Fig. 2
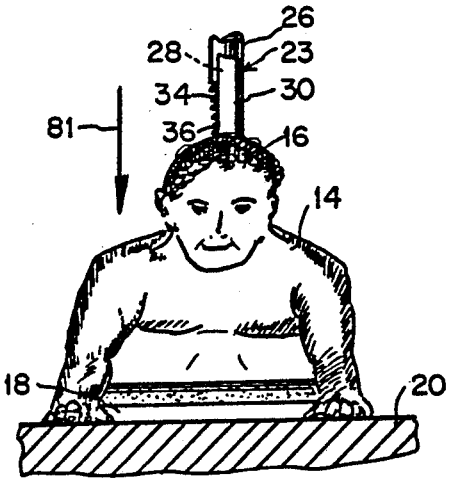
Fig. 3

Fig. 5
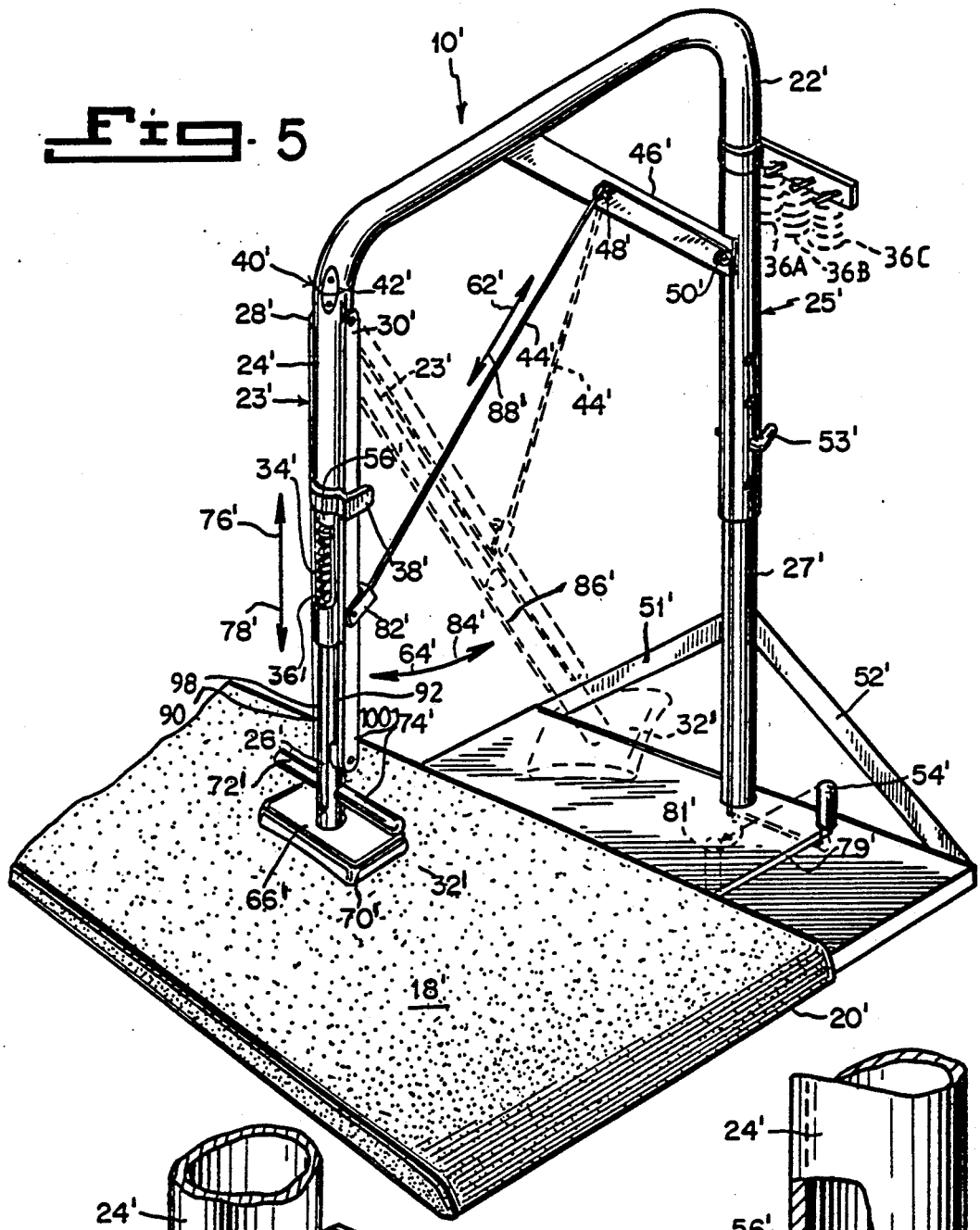
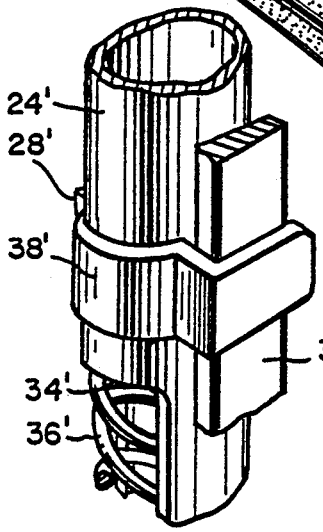
Fig. 7
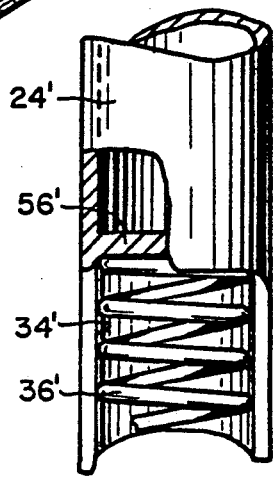
Fig. 6

ISOMETRIC PUSH-UP MACHINE

BACKGROUND OF THE INVENTION

1. Field of the Invention:

The present invention relates to an exercising machine.

More particularly, the present invention relates to an isometric push-up machine.

2. Description of the Prior Art:

Numerous innovations for exercising machines have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide an isometric push up machine that avoids the disadvantages of the prior art.

More particularly, it is an object of the present invention to provide an isometric push-up machine. By placing a pressure spring into the spring compartment, the present invention resists the person using the machine from doing a basic push up in place of a vigorous work out, for the body. The present invention can be set for five different resistances for more or less pressure pushing on the person using during the push ups. Also, by using the straight bar, the present invention enables the user to do several different exercises such as curls, etc. To build a better, stronger and more sculpted body.

The present invention operates by changing the pressure springs which makes it difficult to do the push ups. Therefore, giving the body a superb work out. Also, the user's hands are placed on the foam padded base which can be placed close together or further apart so that a wide range of muscles can be isolated and worked on, such as chest, shoulders, back, arms, etc.

The present invention can be built relatively inexpensively in today's fitness market. It can be made portable for home or office use because it can be folded and stored away. A permanent apparatus for fitness centers across the country, this machine would be an asset to today's growing number of people involved in fitness.

In keeping with these objects, and with others which will become apparent hereinafter, one feature of the present invention resides, briefly stated, in a wall mounted isometric push-up machine for a user, comprising, a first member having a first end and a second end, a second member having a second end and a first end that is pivotally connected to the first end of the first member, an applicator being fixedly connected to the second end of the second member, wherein means are provided for regulating the tension the applicator applies to the back of the user.

When the isometric push-up machine is designed in accordance with the present invention, the user can choose his own isometric workout.

In accordance with another feature of the present invention, the first member is an "L"-shaped hollow tube.

Another feature of the present invention is that the "L"-shaped hollow tube is pivotably secured to an adjustable bracket disposed on the wall so that different sized users can work out.

Yet another feature of the present invention is that the adjustable bracket contains a lock pin for maintaining the predetermined height.

Still another feature of the present invention is that the second member includes a hollow tube.

Yet still another feature of the present invention is that the hollow tube contains a large diameter hollow tube and a small diameter hollow tube.

Still yet another feature of the present invention is that the means include a spring compartment disposed intermediate the large diameter hollow tube and the small diameter hollow tube and containing one spring at a time of the plurality of different springs so that the spring can provide the desired amount of tension on the back of the user.

Another feature of the present invention is that the applicator contains a base being substantially rectangular and having a top, a side, and a bottom.

Yet another feature of the present invention is that the base is steel.

Still another feature of the present invention is that the bottom has two ends and contains a pair of heavy foam pads each being disposed at an end of the pair of the ends, and a lighter foam pad disposed intermediate the pair of heavy foam pads so that the bottom assumes the shape similar to the curvature of the back of the user.

Yet still another feature of the present invention is that the top of the applicator receives an end of the small diameter hollow tube.

Still yet another feature of the present invention is that it further comprises a pair of colinear rods disposed on the small diameter hollow tube so that the user can also do curb exercises.

Another feature of the present invention is that it further provides a cable connected to a handle that allows the second member to achieve a retracted position so that the user can leave without getting hurt.

Yet another feature of the present invention is that the small diameter tube contains a pair of longitudinal slots for receiving a pair of rollers on a pair of rods.

In keeping with these objects, and with others which will become apparent hereinafter, one feature of the present invention resides, briefly stated, in floor mounted isometric push-up machine for a user, including, a first member having a first end and a second end and being height adjustable by including two telescopic hollow tubes locked in position by a lock pin, a second member having a second end and a first end that is pivotally connected to the first end of the first member, an applicator being fixedly connected to the second end of the second member, and wherein means are provided for regulating the tension the applicator applies to the back of the user.

When the isometric push-up machine is designed in accordance with the present invention, the user can choose his own workout.

Still another feature of the present invention is that the first member is an "L"-shaped hollow tube.

Yet still another feature of the present invention is that the "L"-shaped hollow tube is secured to a base disposed on the floor so that different sized users can work out.

Still yet another feature of the present invention is that the second member includes a hollow tube.

Another feature of the present invention is that the hollow tube contains a large diameter hollow tube and a small diameter hollow tube.

Yet another feature of the present invention is that the means include a spring compartment disposed intermediate the large diameter hollow tube and the small diameter hollow tube and containing one spring at a time of the plurality of different springs so that the spring an provide the desired tension on the back of the user.

Still another feature of the present invention is that the applicator contains a base being substantially rectangular and having a top and a bottom.

Yet still another feature of the present invention is that the base is steel.

Still yet another feature of the present invention is that the bottom has two ends and contains a pair of heavy foam pads each being disposed at an end of a pair of the ends and a lighter foam pad disposed intermediate the pair of heavy foam pads so that the bottom assumes a shape similar to the curvature of the back of the user.

Another feature of the present invention is that the top of the applicator receives an end of the small diameter hollow tube.

Yet another feature of the present invention is that it further comprises a pair of colinear rods disposed on the small diameter hollow tube so that the user can also do curb exercises.

Still another feature of the present invention is that it further provides a cable connected to a handle that allows the second member to achieve a retracted position so that the user can leave without getting hurt.

Yet still another feature of the present invention is that the small diameter tube contains a pair of longitudinal slots for receiving a pair of rollers on a pair of rods.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 1 is a perspective view of a user utilizing the isometric push-up machine of the present invention, made to be mounted on a wall;

FIG. 2 is a front view of the user utilizing the isometric push-up machine of the present invention, shown in FIG. 1, and in the resistive up stroke;

FIG. 3 is a front view of the user utilizing the isometric push-up machine of the present invention, shown in FIG. 1, and in the non-resistive down stroke;

FIG. 4 is a side view of a plurality of springs encased in thin rubber and varying in resistance;

FIG. 4A is a side view of a spring chosen from the plurality of springs and inserted into the isometric push-up machine of the present invention;

FIG. 5 is a perspective view of an alternate embodiment of the isometric push-up machine of the present invention, made for placement on the floor;

FIG. 6 is a perspective view of a spring seat causing the spring to bias the smaller lower inner hollow shaft downwardly;

FIG. 7 is a perspective view of the clamp holding the first metal rod and the second metal rod against the larger, upper, outer hollow shaft; and FIG. 8 is a side view of the applicator of the present invention.

LIST OF REFERENCE NUMERALS UTILIZED IN THE DRAWING

10—isometric push-up machine
12—wall on which the isometric push-up machine 10 is mounted
14—back of the isometric push-up machine 10
16—user of the isometric push-up machine 10
18—cushion mat on the floor 20 for the user 16
20—floor for the cushion meat 18
22—"L"-shaped hollow tube
23—working portion of the "L"-shaped hollow tube 22
24—larger outer upper hollow tube
25—non-working portion of the "L"-shaped hollow tube 22
26—smaller inner lower hollow tube
28—first outer flat rod for connecting the larger outer upper hollow tube 24 to the smaller inner lower hollow tube 26
30—second outer flat rod for connecting the larger outer upper hollow tube 24 to the smaller inner lower hollow tube 26
32—applicator connected to the smaller inner lower hollow tube 26
34—spring compartment attached intermediately to the larger outer upper hollow tube 24 and the smaller inner lower hollow tube 26
36—spring disposed in the spring compartment 34
36A—spring with a first resistance
36B—spring with a second resistance
36C—spring with a third resistance
38—connector attached to the larger outer upper hollow tube 24
40—hinge pivotally connecting the "L"-shaped hollow tube 22 to the larger outer upper hollow tube 24
42—pivot point disposed at the intersection of the "L"-shaped hollow tube 22 and the larger outer upper hollow tube 24
44—steel cable for displacing the working portion 23
46—support bar for strengthening the "L"-shaped hollow tube 22
48—first roller of the support bar 46
50—second roller of the support bar 46
52—mounting bracket disposed on the wall 12
53—lock pin for securing the "L"-shaped hollow tube 22 to the mounting bracket 52
54—handle disposed on the wall 12
56—metal stopper for seating the spring 36
58—first slot contained in the smaller inner lower hollow tube 26
60—second slot contained in the smaller inner lower hollow tube 26
62—arrow showing the direction of travel of the steel cable 44
64—arrows showing the direction of travel of the working portion 23
66—steel base of the applicator 32
68—end foam pads attached to the steel base 66
70—center foam pad attached to the steel base 66
72—first curling bar disposed on the smaller inner lower hollow tube 26
74—second curling bar disposed on the smaller inner lower hollow tube 26
76—arrow showing the direction of travel of the smaller inner lower hollow tube 26
79—track for the handle 54
80—a pair of colinear handles on the smaller inner lower hollow tube 26

81—arrow showing direction of travel of the handle disposed on the wall 12
82—clamp
83—arrow showing the direction the user 16 is moving
84—arrow showing the direction of travel of the working portion 23
88—arrow showing the direction of working portion 23
90—first roller
92—second roller
94—upper end of the first outer flat rod 28
96—upper end of the second outer flat rod 30
98—lower end of the first outer flat rod 28
100—upper end of the second outer flat rod 30
10'—isometric push-up machine
18'—cushion mat on the floor 20' for the user 16'
20'—floor for the cushion mat 18'
22'—"L"-shaped hollow tube
23'—working portion of the "L"-shaped hollow tube 22'
24'—larger outer upper hollow tube
25'—non-working portion of the "L"-shaped hollow tube 22'
26'—smaller inner lower hollow tube
28'—first outer flat rod for connecting the larger outer upper hollow tube 24' to the smaller inner lower hollow tube 26'
30'—second outer flat rod for connecting the larger outer upper hollow tube 24' to the smaller inner lower hollow tube 26'
32'—applicator connected to the smaller inner lower hollow tube 26'
34'—spring compartment attached intermediately to the larger outer upper hollow tube 24' and the smaller inner lower hollow tube 26'
36'—spring disposed in the spring compartment 34'
36A'—spring with a first resistance
36B'—spring with a second resistance
36C'—spring with a third resistance
38'—connector attached to the larger outer upper hollow tube 24'
40'—hinge pivotally connecting the "L"-shaped hollow tube 22' to the larger outer upper hollow tube 24'
42'—pivot point disposed at he intersection of the "L"-shaped hollow tube 22' and the larger outer upper hollow tube 24'
44'—steel cable for displacing the working portion 23'
46'—support bar for strengthening the "L"-shaped hollow tube 22'
48'—first roller of the support bar 46'
50'—second roller of the support bar 46'
51'—first support bar
52'—second support bar
53'—lock pin for securing the "L"-shaped hollow tube 22' to the mounting bracket 52'
54'—handle disposed on the wall 12'
56'—metal stopper for seating the spring 36'
58'—first slot contained in the smaller inner lower hollow tube 26'
60'—second slot contained in the smaller inner lower hollow tube 26'
62'—arrow showing the direction of travel of the steel cable 44'
64'—arrows showing the direction of travel of the working portion 23'
66'—steel base of the applicator 32'
68'—end foam pads attached to the steel base 66'
70'—center foam pad attached to the steel base 66'
72'—first curling bar disposed on the smaller inner lower hollow tube 26'
74'—second curling bar disposed on the smaller inner lower hollow tube 26'
76'—arrow showing the direction of travel of the smaller inner lower hollow tube 26'
78'—arrow showing the direction the user is moving
79'—track for the handle 54'
81'—arrow showing direction of travel of the handle disposed on the wall 12'
82'—clamp
84'—arrow showing the direction of travel of the working portion 23'
88'—arrow showing the direction of working portion 44'
90'—first roller
92'—second roller
94'—upper end of the first outer flat rod 28'
96'—upper end of the second outer flat rod 30'
98'—lower end of the first outer flat rod 28'
100'—lower end of the second outer flat rod 30'.

DETAILED DESCRIPTION OF THE PREFERRED EMBODIMENT

Referring now to FIGS. 1 through 4A, the isometric push-up machine of the present invention is shown generally at 10, mounted to a wall 12, and being used on the back 14 of a user 16 while the user 16 lies on a cushion mat 18 disposed on the floor 20.

The isometric push-up machine 10 includes a hollow "L"-shaped hollow tube 22, a larger outer upper hollow tube 24, a smaller inner lower hollow tube, a first outer rod 28, a second outer rod 30, an applicator 32, a spring compartment 34, a spring 36, a connector 38, a hinge 40, a pivot point 42, a steel cable 44, but is not limited to steel, a support bar 46, a first roller 48, a second roller 50, a mounting bracket 52, a handle 54, a lock pin 53 and a metal stopper 56.

In FIG. 2, the arrow 76 indicates the direction of which the user 16 is applying pressure. The arrow 76 also indicates the direction the user 16 is moving.

Since the spring 36 is seated in a metal stopper 56, disposed in the working portion 23, it biases the smaller inner lower hollow tube 26 in a downwardly direction. No energy is expended by the user 16 when the user 16 executes the movement in the direction of the arrow.

The resistance in the smaller inner lower hollow tube 26 is created by the springs 36A, 36B, or 36C, shown in FIG. 4.

As shown in FIG. 4A, the spring 36A or 36B or 36C is disposed in the spring compartment 34. Since, the springs 36A, 36B, and 36C, are independent of each other, by merely changing the spring 36 to a spring of different resistance a small variety of independent resistances can be utilized by the user 16, when pushing up in the direction of arrow 76.

FIG. 8 shows the details of the applicator 32. The applicator 32 includes a steel base 66, but is not limited to steel. The end foam pads 68 are larger than the center foam pad 70 so as to more better follow the curvature of the back 14 of the user 16. The smaller inner lower hollow tube 26 enters and attaches to the steel base 66.

A brief distance upward on the first smaller inner lower hollow tube 26, from the steel base 66, is disposed a pair of colinear handles used for doing curl arm exercises.

In order for the user 16 to enter and/or leave the isometric push-up machine 10, conveniently, the working portion 23 of the isometric push-up machine 10 swings inwardly, via the pivot point 42, when the handle 54 is pulled in its track.

When the handle 54 is pulled in the direction of arrow 81, the steel cable 44 being pivotally attached to the clamp 82, causes the working portion 23 to move in the direction of arrow 84 until the working portion 23 assumes the retracted position, shown in phantom.

The spring compartment 34 is disposed intermediate the non-working portion 25 and the larger outer upper hollow tube 24 and adds strength to the working portion 23. In order for the working portion 23 to retract in the direction of arrow 84, a hinge 40 allows the working portion 23 to pivot at point 42 in the direction of arrow 84 to the retracted position.

The first outer flat rod 28 and the second outer flat rod 30 are pivotably attached to the larger outer upper hollow tube 24 at the upper ends 94 and 96, while the lower ends 98 and 100 contain roller s 90 and 92 which ride in the first slot 58 and the second slot 60 of the smaller inner lower hollow tube 26 so that the smaller inner lower hollow tube 26 and the first outer flat rod 28 and the second outer flat rod 30 can move independently from each other.

The cable 44 originates at the clamp 82, passes around the first roller 48, and the second roller 50, and the non-working portion 25 underneath the base and up again on the handle 54. Once the user 16 is in place in the isometric push-up machine 10, the handle 54 is moved up to its original position which causes the cable 44 to slack and move in the direction of arrow 88 and allow the working portion 23 to return to its working position.

The non-working portion 25 is adjustably disposed in a wall bracket 52 which uses a lock pin 53 once the proper adjustment is obtained.

Referring now to FIGS. 5 through 7, the isometric push-up machine of the present invention is shown generally at 10', free standing on the floor 20', and being used on the back of a user while the user lies on a cushion mat 18' disposed on the floor 20'.

The isometric push-up machine 10' includes a hollow "L"-shaped hollow tube 22', a larger outer upper hollow tube 24', a smaller inner lower hollow tube 26', containing a first slot 58' and a second slot 60', a first outer rod 28', a second outer rod 30', an applicator 32', a spring compartment 34', a spring 36', a connector 38', a hinge 40', a pivot point 42', a steel cable 44', but is not limited to steel, a support bar 46', a first roller 48', a second roller 50', a pair of support bars 52' and 53', a handle 54', a lock pin 53' and a metal stopper 56'.

The arrow 76' indicates the direction of which the user is applying pressure. The arrow 78' indicates the direction the user is moving.

Since the spring 36' is seated in a metal stopper 56', disposed in the working portion 23', it biases the smaller inner lower hollow tube 26' in a downwardly direction, no energy is expended by the user when the user executes the movement in the direction of arrow 78'.

The resistance in the smaller inner lower hollow tube 26' is created by the springs 36A', 36B', or 36C'.

The spring 36A' or 36B' or 36C' is disposed in the spring compartment 34'. Since, the springs 36A', 36B', and 36C', are independent of each other, by merely changing the spring 36' to a spring of different resistance a small variety of independent resistances can be utilized by the user, when pushing up in the direction of the arrow 76'.

FIG. 8 shows the details of the applicator 32'. The applicator 32' includes a steel base 66', but is not limited to steel. The end foam pads 68 are larger than the center foam pad 70' so as to more better follow the curvature of the back 14' of the user. The smaller inner lower hollow tube 26' enters and attaches to the steel base 66'.

A brief distance upward on the first smaller inner lower hollow tube 26', from the steel base 66', is disposed a pair of colinear handles used for doing curling arm exercises.

In order for the user to enter and/or leave the isometric push-up machine 10', conveniently, the working portion 23' of the isometric push-up machine 10' swings inwardly via the pivot point 42', when the handle 54' in its track is pulled.

When the handle 54' is pulled in the direction of arrow 81', the steel cable 44' being pivotally attached to the clamp 82', causes the working portion 23' to move in the direction of arrow 84' until the working portion 23' assumes the retracted position, shown in phantom.

The spring compartment 34' is disposed intermediate the non-working portion 25' and the larger outer upper hollow tube 24' and adds strength to the working portion 23'. In order for the working portion 23' to retract in the direction of arrow 84', a hinge 40' allows the working portion 23' to pivot at point 42' in the direction of arrow 84' to the retracted position.

The first outer flat rod 28' and the second outer flat rod 30' are pivotably attached to the larger outer upper hollow tube 24' at the upper ends 94 and 96, while the lower ends 98' and 100' contain rollers 90' and 92' which ride in the first slot 58' and the second slot 60' of the smaller inner lower hollow tube 26' so that the smaller inner lower hollow tube 26' and the first outer flat rod 28' and the second outer flat rod 30' can move independently of each other.

The cable 44' originates at the clamp 82', passes around the first roller 48' and the second roller 50' sown the non-working portion 25' underneath the base and up again on the handle 54'. Once the user is in place in the isometric push-up machine 10', the handle 54' is moved up to its original position which causes the cable 44' to slack and move in the direction of arrow 88' and allows the working portion 23' to return to its working position.

The non-working portion 25' is adjustably disposed in a wall bracket 52' which uses a lock pin 53' once the proper adjustment is obtained.

It will be understood that each of the elements described above, or two or more together, may also find a useful application in other types of constructions differing from the type described above.

While the invention has been illustrated and described as embodied in an isometric push-up machine, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A wall mounted isometric push-up machine for a user, comprising:
(a) a first member having a first end and a second end, said first member is an "L"-shaped hollow tube;
(b) a second member having a second end and a first end that is pivotally connected to said first end of said first member;
(c) an applicator being fixedly connected to said second end of said second member; and
(d) means for regulating the tension said applicator applies to the back of the user so that the user can choose his own comfortable amount.

2. A push-up machine as defined in claim 1, wherein said "L"-shaped hollow tube is pivotably secured to an adjustable bracket disposed on the wall so that different sized users can work out.

3. A push-up machine as defined in claim 2, wherein said adjustable bracket contains a lock pin for maintaining the predetermined height.

4. A push-up machine as defined in claim 3, wherein said second member includes a hollow tube.

5. A push-up machine as defined in claim 4, wherein said hollow tube contains a large diameter hollow tube and a small diameter hollow tube.

6. A push-up machine as defined in claim 5, wherein said means include a spring compartment disposed intermediate said large diameter hollow tube and said small diameter hollow tube and containing a plurality of different springs so that said spring an provide the desired tension on the back of the user.

7. A push-up machine as defined in claim 6, wherein said applicator contains a base being substantially rectangular and having a top side and a bottom side.

8. A push-up machine as defined in claim 7, wherein said base is steel.

9. A push-up machine as defined in claim 8, wherein said bottom side has two ends and contains a pair of heavy foam pads each being disposed at an edge of a pair of said ends and a lighter foam pad disposed intermediate the pair of heavy foam pads so that said bottom side assumes shape similar to the curvature of the back of the user.

10. A push-up machine as defined in claim 9, wherein said top side of said applicator receives an end of said small diameter hollow tube.

11. A push-up machine as defined in claim 10 further comprising a pair of colinear rods disposed on said small diameter hollow tube so that the user can also do curb exercises.

12. A push-up machine as defined in claim 11; further providing a cable connected to a handle that allows said second member to achieve a retracted position so that the user can leave without getting hurt.

13. A push-up machine as defined in claim 12, wherein said small diameter tube contains a pair of longitudinal slots for receiving a pair of rollers on a pair of rods.

14. A floor mounted isometric push-up machine for a user, comprising:
(a) a first member having a first end and a second end and being height adjustable by including two telescopic hollow tubes locked in position by a lock pin, said first member is an "L"-shaped hollow tube;
(b) a second member having a second end and a first end that is pivotally connected to said first end of said first member;
(c) an applicator being fixedly connected to said second end of said second member; and
(d) means for regulating the tension said applicator applies to the back of the user so that the user can choose his own comfortable amount.

15. A push-up machine as defined in claim 14, wherein said "L"-shaped hollow tube is secured to a base disposed on the floor so that different sized users can work out.

16. A push-up machine as defined in claim 15, wherein said second member includes a hollow tube.

17. A push-up machine as defined in claim 16, wherein said hollow tube contains a large diameter hollow tube and a small diameter hollow tube.

18. A push-up machine as defined in claim 17, wherein said means include a spring compartment disposed intermediate said large diameter hollow tube and said small diameter hollow tube and containing a plurality of different springs so that said spring an provide the desired tension on the back of the user.

19. A push-up machine as defined in claim 18, wherein said applicator contains a base being substantially rectangular and having a top side and a bottom side.

20. A push-up machine as defined in claim 19, wherein said base is steel.

21. A push-up machine as defined in claim 20, wherein said bottom side has two ends and contains a pair of heavy foam pads each being disposed at an edge of a pair of said ends and a lighter foam pad disposed intermediate the pair of heavy foam pads so that said bottom side assumes shape similar to the curvature of the back of the user.

22. A push-up machine as defined in claim 21, wherein said top side of said application receives an end of said small diameter hollow tube.

23. A push-up machine as defined in claim 22; further comprising a pair of colinear rods disposed on said small diameter hollow tube so that the user can also do curb exercises.

24. A push-up machine as defined in claim 23; further providing a cable connected to a handle that allows said second member to achieve a retracted position so that the user can leave without getting hurt.

25. A push-up machine as defined in claim 24, wherein said small diameter tube contains a pair of longitudinal slots for receiving a pair of rollers on a pair of rods.

* * * * *